United States Patent [19]

Chielens

[11] Patent Number: 4,815,519

[45] Date of Patent: Mar. 28, 1989

[54] DEVICE FOR SUPPORTING AND COOLING A CONTINUOUS CASTING EMERGING FROM A MOLD

[75] Inventor: Alain Chielens, Mouvaux, France

[73] Assignee: Dujardin Montbard Somenor Z. I. Lille-Seclin, Seclin Cedex, France

[21] Appl. No.: 172,296

[22] Filed: Mar. 23, 1988

[30] Foreign Application Priority Data

Mar. 23, 1987 [FR] France ..... 87/03964

[51] Int. Cl.[4] ..... B22D 11/12; B22D 11/124

[52] U.S. Cl. ..... 164/441; 164/444

[58] Field of Search ..... 164/444, 441, 486

[56] References Cited

U.S. PATENT DOCUMENTS

| | | | |
|---|---|---|---|
| 3,654,989 | 4/1972 | Meier et al. | 164/441 X |
| 3,753,459 | 8/1973 | Burkhardt et al. | 164/444 X |
| 3,934,641 | 1/1976 | Chielens | 164/444 X |
| 4,501,314 | 2/1985 | Wakabayashi et al. | 164/441 |
| 4,537,241 | 8/1985 | Kanamori | 164/441 X |

FOREIGN PATENT DOCUMENTS

| | | | |
|---|---|---|---|
| 0107563 | 5/1984 | European Pat. Off. | 164/441 |
| 2007587 | 9/1971 | Fed. Rep. of Germany | 164/441 |
| 2809804 | 9/1978 | Fed. Rep. of Germany | 164/444 |
| 59-189052 | 10/1984 | Japan | 164/444 |

*Primary Examiner*—Nicholas P. Godici
*Assistant Examiner*—J. Reed Batten, Jr.
*Attorney, Agent, or Firm*—Kurt Kelman

[57] ABSTRACT

A device for supporting and cooling a continuous casting emerging from a discharge end of a mold comprises a member having a support surface and mounted below the mold at the discharge end thereof in such a manner that one of the faces of the emerging continuous casting comes into contact with the support surface of the member and glides therealong, the member defining cavities spaced along the support surface, spraying heads positioned in the cavities to project jets of a cooling fluid onto the face of the emerging continuous casing in contact with the support surface of the member. To permit atomization of the cooling fluid, the device also comprises an atomizing chamber for the cooling fluid affixed to the member at a distance from the cavities, the member defining conduits connecting the atomizing chamber to the spraying heads, the conduits having outlet ends at the cavities and the spraying heads being mounted on the outlet ends of the conduits.

3 Claims, 2 Drawing Sheets

DEVICE FOR SUPPORTING AND COOLING A CONTINUOUS CASTING EMERGING FROM A MOLD

BACKGROUND OF THE INVENTION

1. Field of the Invention

The present invention relates to a device for supporting and cooling a continuous casting emerging from a discharge end of a mold, which comprises a member having a support surface and mounted below the mold at the discharge end thereof in such a manner that one of the faces of the emerging continuous casting comes into contact with the support surface of the member and glides therealong, the member defining cavities spaced along the support surface, spraying heads positioned in the cavities to project jets of a cooling fluid onto the face of the emerging continuous casting in contact with the support surface of the member. More particularly but not exclusively, devices of this type are used to support and cool the small faces of a continuous metal casting having a rectangular cross section and considerable width, such as a steel slab.

2. Description of the Prior Art

Spraying nozzles fed by water or another cooling liquid are used in known devices of this type. Although it is known that cooling by an atomized cooling fluid, that is a projection upon the face of the emerging continuous casting of fine droplets of water suspended in a current of air, is much more effective and protective of the casting face than cooling by a liquid spray, it has been impossible to use this better mode of cooling in the known devices because atomizing nozzles are too big to be housed in the cavities of the support member. Whatever their structure, such nozzles always comprise an atomizing chamber where the cooling liquid is divided into droplets and these droplets are dispersed in a current of air, and a conduit of some length must feed the liquid-air mixture from the atomizing chamber to a spraying head pierced by an orifice of a suitable shape to produce a jet of atomized cooling fluid of the desired shape.

SUMMARY OF THE INVENTION

It is the primary object of this invention to permit the utilization of a cooling system providing an atomized cooling fluid in devices for supporting and cooling a continuous casting emerging from a discharge end of a mold.

In a device of the first-indicated type, this and other objects are accomplished with an atomizing chamber for the cooling fluid affixed to the member at a distance from the cavities, the member defining conduit means connecting the atomizing chamber to the spraying heads, the conduit means having outlet ends at the cavities and the spraying heads being mounted on the outlet ends of the conduits.

The invention is of particular interest when the device is used to support and cool the two internal faces of twin continuous castings emerging from a mold with twin mold cavities and gliding along two opposite support surfaces of the member. In this case, the space available under the mold between the support surfaces is quite small. According to a preferred embodiment of this invention, therefore, the device member has two opposite support surfaces in contact with the respective faces of the emerging continuous castings, the cavities extend transversely through the member and have open ends at the opposite support surfaces, each spraying head projects two oppositely directed jets of the atomized cooling fluid towards the open ends at the faces of the emerging continuous castings gliding along the support faces, and the atomizing chamber is disposed laterally of the member between the two planes defined by the support surfaces.

The above and other objects, advantages and features of the present invention will become more apparent from the following detailed description of a now preferred embodiment thereof, taken in conjunction with the accompanying schematic drawing.

DESCRIPTION OF THE PREFERRED EMBODIMENTS

Figure 1:
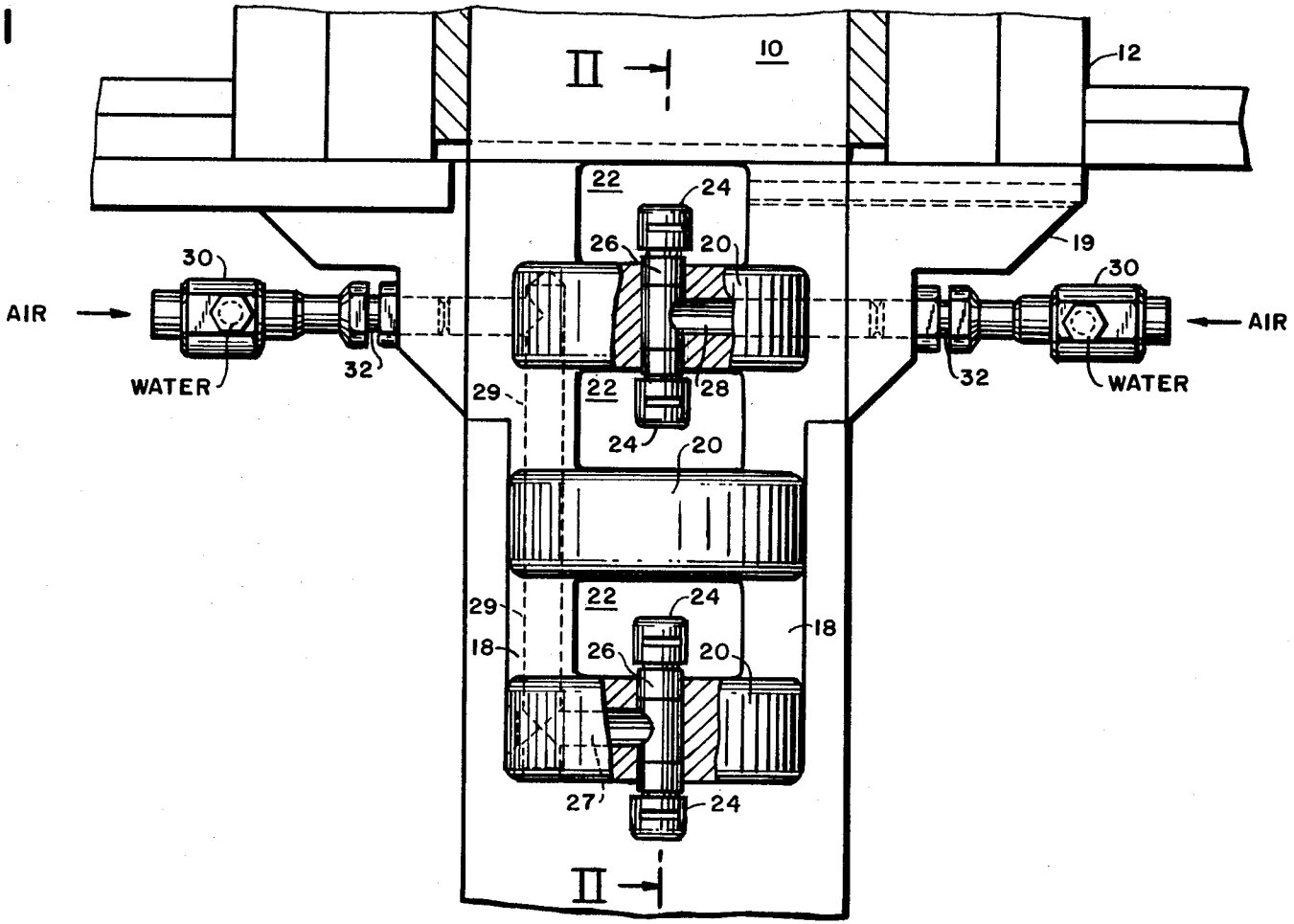
FIG. 1 is an elevational view of a device for supporting and cooling the small internal faces of twin steel slabs produced in a mold of rectangular cross section whose internal mold cavity is partitioned by a transverse separating wall.
Figure 2:
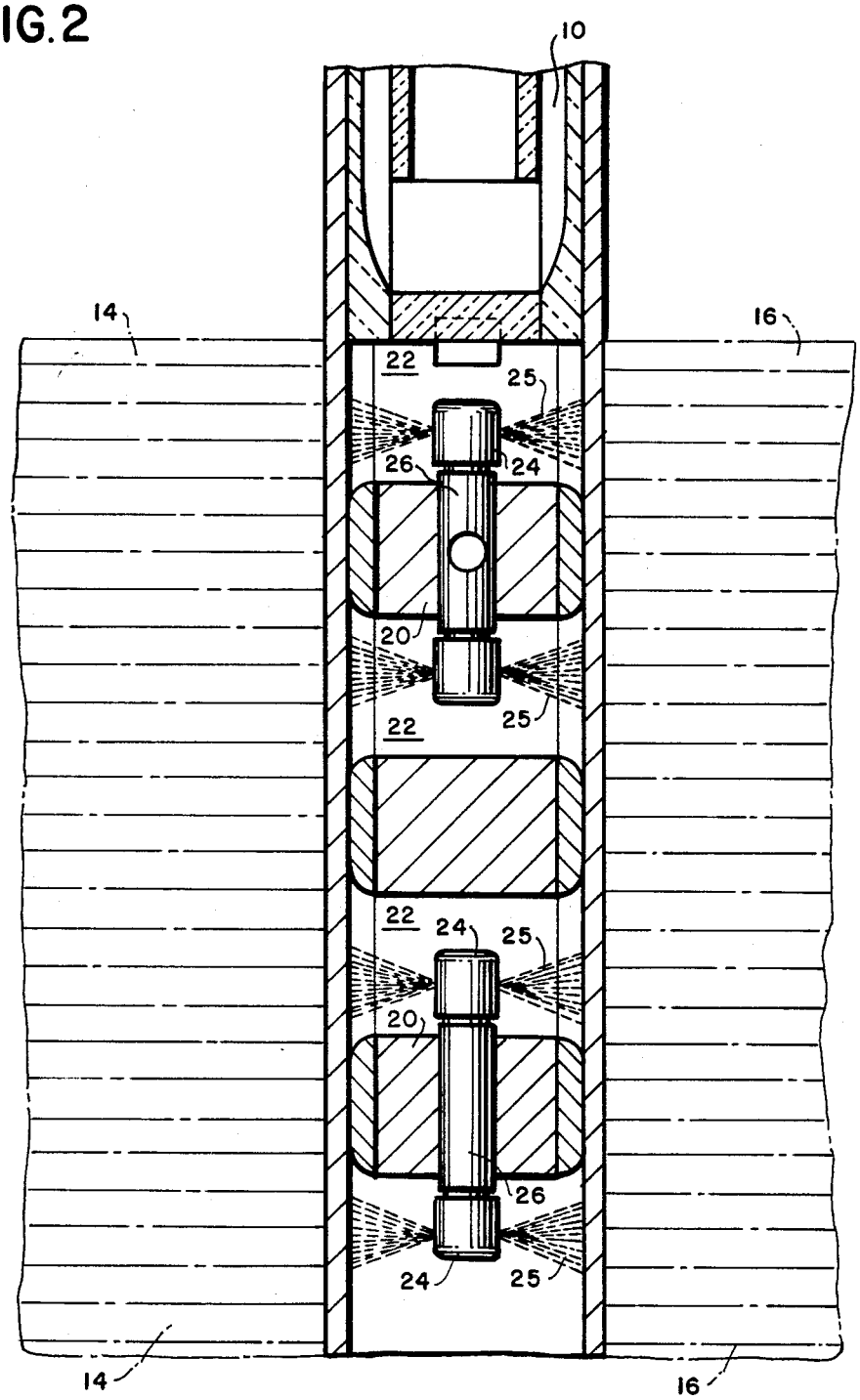
FIG. 2 is a cross section along line II—II of FIG. 1.

Referring now to the drawing, the illustrated device for supporting and cooling the small internal faces of twin slabs 14, 16 emerging continuously from a discharge end of casting mold 12, whose mold cavity is divided by separating wall 10 into two halves, comprises grate member 18 having opposite support surfaces and mounted below the mold at the discharge end thereof in vertical alignment with the separating wall. This elongated grate member has flanges 19 at an upper part thereof for affixing the grate member to the mold. The grate member has transversely extending bars 20 forming the support surfaces and it is arranged in such a manner that the faces of the emerging continuous castings 14, 16 come into contact with the support surfaces of member 18 and glide therealong. Grate member 18 defines cavities 22 spaced along the support surfaces and spraying heads 24 are positioned in cavities 22 inside member 18 to project jets 25 of an atomized cooling fluid onto the faces of the emerging continuous castings in contact with the support surfaces of grate member 18. The spraying heads have one or more slots in their end faces directed towards the small internal faces of twin slabs 14, 16.

Atomizing chamber 30 for the cooling fluid is affixed to grate member 18 at a distance from cavities 22 and grate member 18 defines conduit means 26, 28 connecting the atomizing chamber to spraying heads 24. The conduit means comprises vertical conduits 26 passing through grate bars 20 and having threaded outlet ends at cavities 22 and spraying heads 24 are screwed on the outlet ends of the conduits. The conduit means further comprises conduits 28 leading into conduits 26 and having inlet ends emerging from the grate member at the sides thereof at substantially the same level as uppermost conduit 26. In the illustrated embodiment, the inlet ends of conduits 28 are threaded, and a screw-threaded coupling 32 connects a respective atomizing chamber 30 to each threaded inlet end of conduits 28 at each side of grate member 18. The atomizing chambers are disposed laterally of grate member 18 between parallel planes defined by the support surfaces of bars 20. Each atomizing chamber 30 is connected to respective conduits (not shown) supplying air and cooling water to the atomizing chamber, and the atomized cooling water is fed to spraying heads 24 through conduit means 28, 26 to produce oppositely directed jets of atomized cooling fluid wetting the small internal faces of the twin slabs. As shown, conduit 28 from one of the atomizing chambers leads into conduit 26 for the uppermost spraying heads while the conduit means for additional spraying heads 24 housed in adjacent cavities 22 comprises branch conduits 29, 27 defined in grate member 18 and leading into conduit 26 for the lower spraying heads.

The atomizing chambers may be of any known type. For example, the atomizing chamber may have an axially extending air inlet, a laterally extending water inlet and an anvil positioned in front thereof and breaking the entering water current in the chamber. Whatever the structure of the atomizing chamber, the grate member may be equipped with a cooling system using atomized cooling fluids despite the small space available between the supported faces of the continuous casting being cooled.

Obviously, many modifications may occur to those skilled in the art. For example, the number of spraying heads, the number of discharge slots in these heads as well as their position, and the number of atomizing chambers may differ. As shown, one or more of the atomizing chambers may feed more than two spraying heads. If the device is used to guide, support and cool the small external faces of continuously emerging castings, the spraying heads will have discharge slots or orifices only at one end face directed towards the respective external casting face and they may be positioned in cavities in a plain plate member.

What is claimed is:

1. A device for supporting and cooling a continuous casting emerging from a discharge end of a mold, which comprises a member having a support surface and mounted below the mold at the discharge end thereof in such a manner that one of the faces of the emerging continuous casting comes into contact with the support surface of the member and glides therealong, the member defining cavities spaced along the support surface, spraying heads positioned in the cavities to project jets of a cooling fluid onto the face of the emerging continuous casting in contact with the support surface of the member, and an atomizing chamber for the cooling fluid affixed to the member at a distance from the cavities, the member defining conduit means connecting the atomizing chamber to the spraying heads, the conduit means having outlet ends at the cavities and the spraying heads being mounted on the outlet ends of the conduit means.

2. The device of claim 1, wherein the member has two opposite support surfaces in contact with respective ones of the faces of twin emerging continuous castings, the cavities extend transversely through the member and have open ends at the opposite support surfaces, each one of the spraying heads projects two oppositely directed jets of the atomized cooling fluid towards the open ends at the faces of the emerging continuous castings gliding along the support surfaces, and the atomizing chamber is disposed laterally of the member between the two planes defined by the support surfaces.

3. The device of claim 1, wherein the conduit means has a threaded inlet end, and further comprising a screw-threaded coupling connecting the atomizing chamber to the threaded inlet end of the conduit means.

* * * * *